US007634828B2

(12) United States Patent
Elhabashy

(10) Patent No.: US 7,634,828 B2
(45) Date of Patent: Dec. 22, 2009

(54) SURGICAL LATERAL POSITIONING PILLOW

(76) Inventor: Basim Elhabashy, 4315 Greenbriar La., Weston, FL (US) 33331

( * ) Notice: Subject to any disclaimer, the term of this patent is extended or adjusted under 35 U.S.C. 154(b) by 36 days.

(21) Appl. No.: 11/810,883

(22) Filed: Jun. 7, 2007

(65) Prior Publication Data

US 2008/0301878 A1 Dec. 11, 2008

(51) Int. Cl.
*A61G 13/12* (2006.01)
*A47C 16/00* (2006.01)
*A47G 9/00* (2006.01)

(52) U.S. Cl. ..... 5/623; 5/621; 5/646; 5/647

(58) Field of Classification Search ..... 5/623, 5/621, 624, 632, 646–648, 650, 655.9, 953, 5/652.1

See application file for complete search history.

(56) References Cited

U.S. PATENT DOCUMENTS 3,124,812 A * 3/1964 Milton et al. ..... 5/638
3,604,023 A * 9/1971 Lynch ..... 5/650
3,678,926 A * 7/1972 Strittmatter ..... 602/21
3,903,878 A * 9/1975 Spann ..... 602/21
3,931,654 A * 1/1976 Spann ..... 5/650
4,177,806 A * 12/1979 Griffin ..... 128/892
4,210,317 A * 7/1980 Spann et al. ..... 5/647
4,233,700 A * 11/1980 Spann ..... 5/632
4,265,232 A * 5/1981 Stonich ..... 5/647
4,730,801 A * 3/1988 Cloward ..... 248/118
4,736,477 A * 4/1988 Moore ..... 5/648
4,805,605 A * 2/1989 Glassman ..... 602/24
4,910,818 A * 3/1990 Grabill et al. ..... 5/650
5,117,522 A * 6/1992 Everett ..... 5/648
5,125,123 A * 6/1992 Engle ..... 5/648
5,216,771 A * 6/1993 Hoff ..... 5/648
5,418,991 A * 5/1995 Shiflett ..... 5/650
5,664,271 A * 9/1997 Bellavance ..... 5/632
5,716,334 A * 2/1998 Wade ..... 602/6
5,746,218 A * 5/1998 Edge ..... 128/845
5,878,453 A * 3/1999 Stokes ..... 5/648
6,154,905 A * 12/2000 Frydman ..... 5/648
6,182,311 B1 * 2/2001 Buchanan et al. ..... 5/632
6,182,314 B1 * 2/2001 Frydman ..... 5/648
6,438,779 B1 * 8/2002 Brown ..... 5/648
6,578,218 B2 * 6/2003 Wassilefsky ..... 5/648
6,954,953 B2 * 10/2005 Bordan ..... 5/648
7,017,215 B1 * 3/2006 Singer et al. ..... 5/646
7,441,293 B1 * 10/2008 Singer et al. ..... 5/646

(Continued)

*Primary Examiner*—Robert G Santos
(74) *Attorney, Agent, or Firm*—Robert M. Downey, PA

(57) ABSTRACT

A surgical arm pillow for use with an operating table and associated arm board supports at least one of a patient's laterally positioned arms and the associated shoulder when the patient is lying in a lateral position on the operating table. The surgical arm pillow is made from a resilient foam body that has a top edge and a bottom edge wherein the top edge defines a top arm support channel for receiving and supporting the top arm of the patient and the bottom edge defines a bottom arm channel for receiving the bottom arm the patient. The top arm support channel and the bottom arm channel are vertically spaced one from the other by a distance approximately equal to the width of the shoulders of a human torso at an end of the resilient foam body located most proximate to the patient. Further, the top arm support channel diverges from said bottom arm channel toward an end of the resilient foam body opposite from the patient.

19 Claims, 4 Drawing Sheets

U.S. PATENT DOCUMENTS

2001/0027577 A1* 10/2001 Frydman ..... 5/648
2002/0088057 A1* 7/2002 Wassilefsky ..... 5/648
2003/0005521 A1* 1/2003 Sramek ..... 5/648
2008/0092297 A1* 4/2008 Davis et al. ..... 5/648
2008/0301878 A1* 12/2008 Elhabashy ..... 5/646

* cited by examiner

SURGICAL LATERAL POSITIONING PILLOW

BACKGROUND OF THE INVENTION

1. Field of the Invention

The present invention relates to surgical aids and more particularly to a pillow for supporting a patients shoulders and arms during surgery.

2. Discussion of the Related Art

The medical profession has developed and introduced many innovations in patient care over the years. Many illnesses and injuries affect internal organs or the skeletal-muscular system which are not readily treatable from outside the human body. Since the nineteenth century, surgery techniques have increasingly advanced to become the primary procedural means for treating many internal conditions of patients. Specialized surgical procedures have been developed which are often the only method of patient treatment for certain internal conditions caused by serious illness or injuries. Consequently, the medical profession conducts thousands of surgeries every day of the year in operating rooms across the United States and abroad to correct a wide variety of conditions.

Prior to and throughout surgery, an anesthesiologist administers intravenous drugs or gases to the patient to induce a state of unconsciousness. During normal sleep, a person's level of consciousness is such that the person will continue to react to outside stimuli. In response to those stimuli, the brain sends reflexive signals to the body to reposition itself to prevent injury that may result from maintaining a single position for a prolonged period of time. Since the very nature of surgery is an invasive one, the patient's central nervous system would reflexively react to the surgical invasion. Although anesthesia may be compared to sleep, anesthesia requires a deeper level of unconsciousness than sleep to suppress those natural reflexes. Some surgeries can be very lengthy, and throughout surgery, the patient is maintained in a single position. Staying in this non-reflexive, unconscious state for extended periods of time is not normally experienced during regular sleep and can be problematic to the patient's well being. Medical professionals attending to the patient during surgery must be aware of potential injuries, such as nerve damage, that can result from maintaining a patient in a single position for any extended time period and must take appropriate precautions to prevent such injuries.

The vast majority of surgeries are conducted with the patient lying face up on an operating table, sometimes with the arms outstretched and secured to arm boards attached to the operating table. Arm boards permit the surgical team to maintain ready access to one or both of the patient's arms for the purpose of administering medications, for attaching various physiological monitoring equipment and other medical devices, or for conveniently isolating the patient's arms during surgery. However, not all surgeries are performed with the patient in a face-up, or even a face-down position. Some surgeries by necessity require the patient to be placed in a lateral or semi-lateral position wherein the patient is lying on his or her side.

When a patient is maintained in a lateral or semi-lateral position during surgery, both of the patient's arms extend to the same side of the operating table, with one arm vertically positioned above the other arm. In the lateral position, one of the patient's shoulders is substantially raised above the level of the other which, without external means of support, generally results in the associated arm extending downwardly across the patient's chest. This position can result in the pinching of the brachial plexus nerve located in the underarm area at the juncture of the arm to the body. Prolonged pinching of the brachial plexus nerve can cause temporary or, in some cases, permanent damage to the nerve with the result being a loss of feeling and function to the patient's arm. To prevent such damage when the patient is maintained in a lateral position for surgery, the patient's top arm should extend from the shoulder in a manner substantially perpendicular to the plane of the patient's trunk, parallel to and above the patient's bottom arm. However, most operating tables are constructed to allow attachment of arm boards that extend from either or both sides of the operating table. An arm board is useful to support a patient's outstretched arm at the same level as the operating table. Thus, for patients in a lateral position, their bottom arm is readily supported by an arm board; however, there is no corresponding support for the patient's top shoulder and arm.

Accordingly, there is a need for a mechanism to comfortably and safely support a patient's top arm on an operating table when the patient is placed in a lateral position.

SUMMARY OF THE INVENTION

The present invention is directed to a surgical arm pillow that satisfies the need to maintain the upper shoulder and arm in a raised position substantially parallel to the lower arm while maintaining desired access to the arms. The surgical arm pillow is used with an operating table and associated arm board and supports at least one of a patient's laterally positioned arms and this shoulder when the patient is lying in a lateral position on the operating table. The surgical arm pillow is made from a resilient foam body that has a top edge and a bottom edge. The top edge defines a top arm support channel for receiving and supporting the top arm and shoulder of the patient and the bottom edge defines a bottom arm channel for receiving the bottom arm of the patient. The top arm support channel and the bottom arm channel are vertically spaced one from the other by a distance approximately equal to the width of the shoulders of a human torso. Further, the top arm support channel diverges from the bottom arm channel, at a slight incline, toward an end of the resilient foam body opposite from the patient.

Another aspect of the present invention is a surgical arm pillow for use with an operating table and associated arm board for supporting at least one of a patient's laterally positioned arms and the associated shoulder. The surgical arm pillow is made from a resilient foam body having a top edge and a bottom edge such that the top edge defines a top arm support channel for receiving and supporting the top laterally extending arm of the patient as well as supporting the shoulder, and the bottom edge defines a bottom arm channel for receiving at least the bottom laterally extending arm of the patient. The top arm support channel and the bottom arm channel are vertically spaced, one from the other, by a distance approximately equal to the width of the shoulders of a human torso. The end of the resilient foam body to be positioned closest to the patient further defines a notch in the bottom edge for receiving therein at least a portion of the side of the operating table to permit the surgical arm pillow to be in close proximity to the patient's torso.

Yet another aspect of the present invention is a method for supporting the arms and shoulders of a surgical patient lying in a lateral position on an operating table, wherein both of the patient's arms extend laterally outward from the operating table. First, the bottom arm of the patient is placed on the arm board of the operating table, whereupon a bottom arm channel of a surgical arm pillow is placed over the patient's bottom arm. Accordingly, the patient's bottom arm extends within the bottom arm channel below the pillow. At least a portion of the arm board on which the patient's bottom arm has been placed is also received in the bottom arm channel. The top arm of the patient is placed in the top arm support channel of the surgical arm pillow and intravenous lines and physiological monitoring leads attached to the patient's arms are routed through a slot extending from a side of the pillow into the top arm support channel, thereby supporting the patient's top arm and shoulder. The top arm support channel is positioned such that the patient's top arm diverges upwardly away from the patient's bottom arm, and a top adjustable strap of the surgical arm pillow is affixed over the top of the top arm support channel to secure the patient's arm in the top arm support channel. The surgical arm pillow is slid close to the patient's torso such that a notch in the bottom edge of the surgical arm pillow engages a side portion of the operating table. A bottom adjustable strap of the surgical arm pillow is then affixed around the bottom of the arm board to secure the pillow to the arm board. Finally, a side support strap on the side of the surgical arm pillow is fastened around a vertical stanchion to provide vertical stability to the pillow.

A further aspect of the invention provides for a vertical separation in the pillow to allow angled positioning of one portion of the pillow relative to another portion of the pillow when the arm board is attached to the operating table at an angle other than perpendicular. This allows the patient's arm to be supported with a bend at the elbows.

These and other features, aspects, and advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 2:
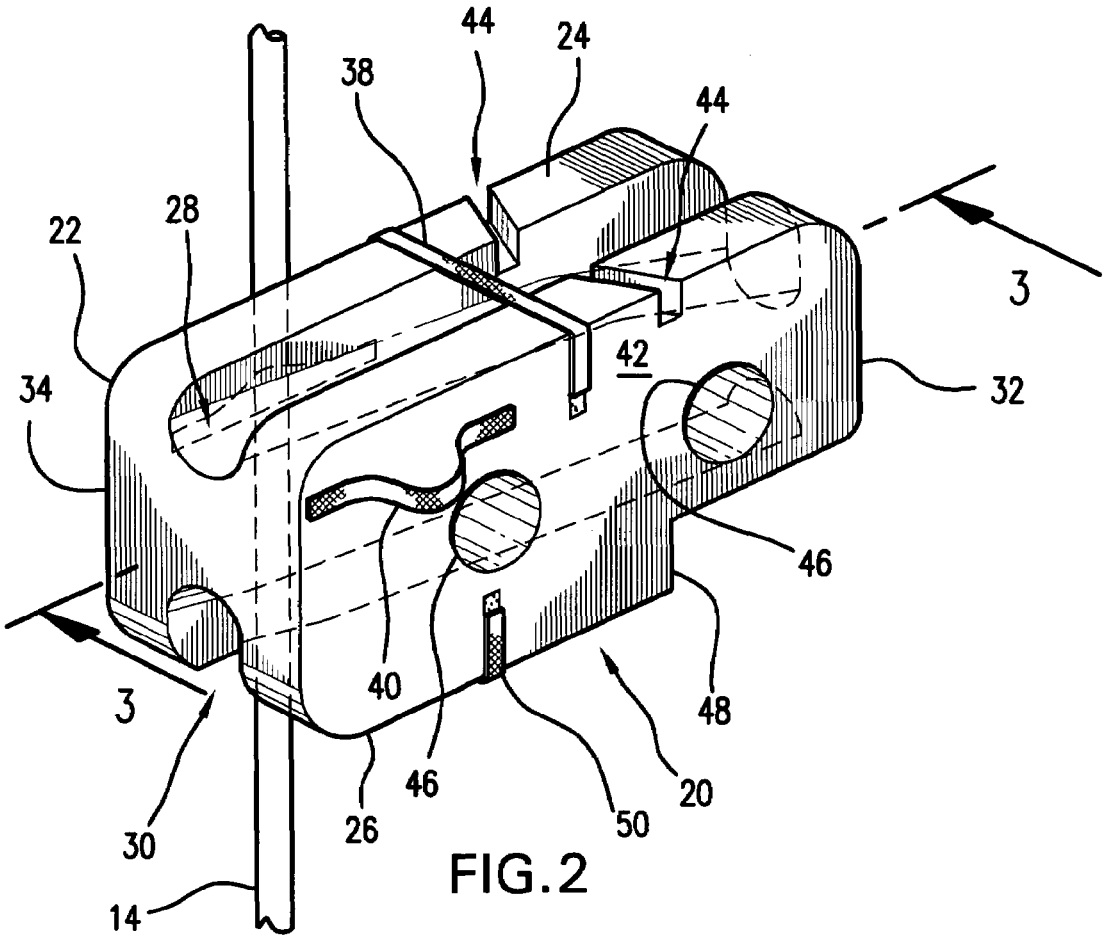
FIG. 2 is a perspective view of a surgical arm pillow.

For purposes of description herein, the terms "upper", "lower", "left", "rear", "right", "front", "vertical", "horizontal", and derivatives thereof shall relate to the invention as oriented in FIG. 2. However, one will understand that the invention may assume various alternative orientations and step sequences, except where expressly specified to the contrary. While the present invention has been shown and described in accordance with preferred and practical embodiments thereof, it is recognized that departures from the instant disclosure are fully contemplated within the spirit and scope of the invention. Hence, specific dimensions and other physical characteristics relating to the embodiments disclosed herein are not to be considered as limiting, unless the claims expressly state otherwise.

Figure 1:
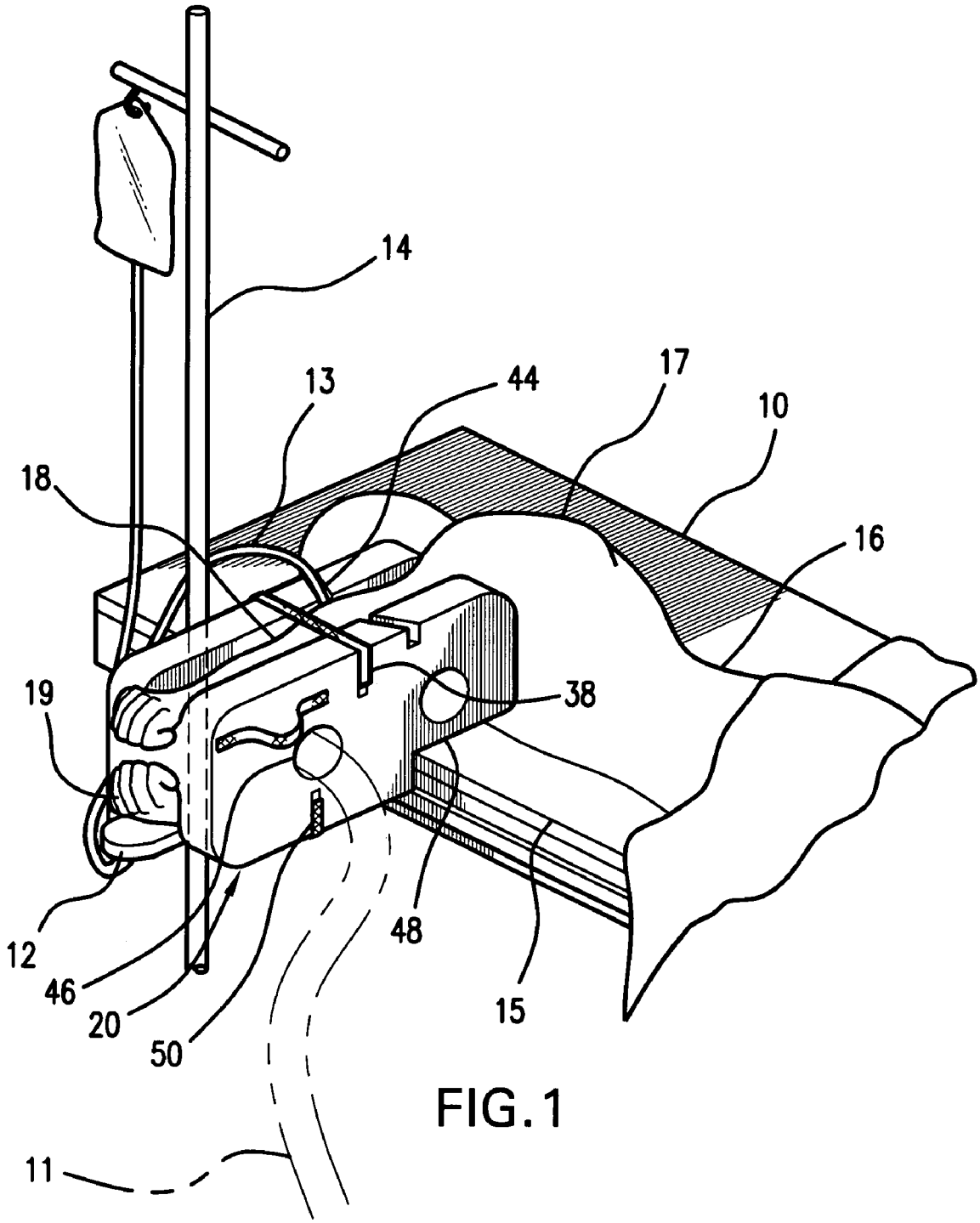
FIG. 1 is a perspective view of a patient on an operating table in a lateral position with his shoulders and arms supported by a surgical arm pillow embodying the present invention.

Turning to the drawings, FIG. 1 shows a surgical arm pillow 20 supporting the top arm 18 and bottom arm 19 of a surgery patient 16 lying in a lateral position on an operating table 10. As shown in greater detail in FIG. 2, surgical arm pillow 20 is one of the preferred embodiments of the present invention and illustrates its various components and configurations.

Figure 3:
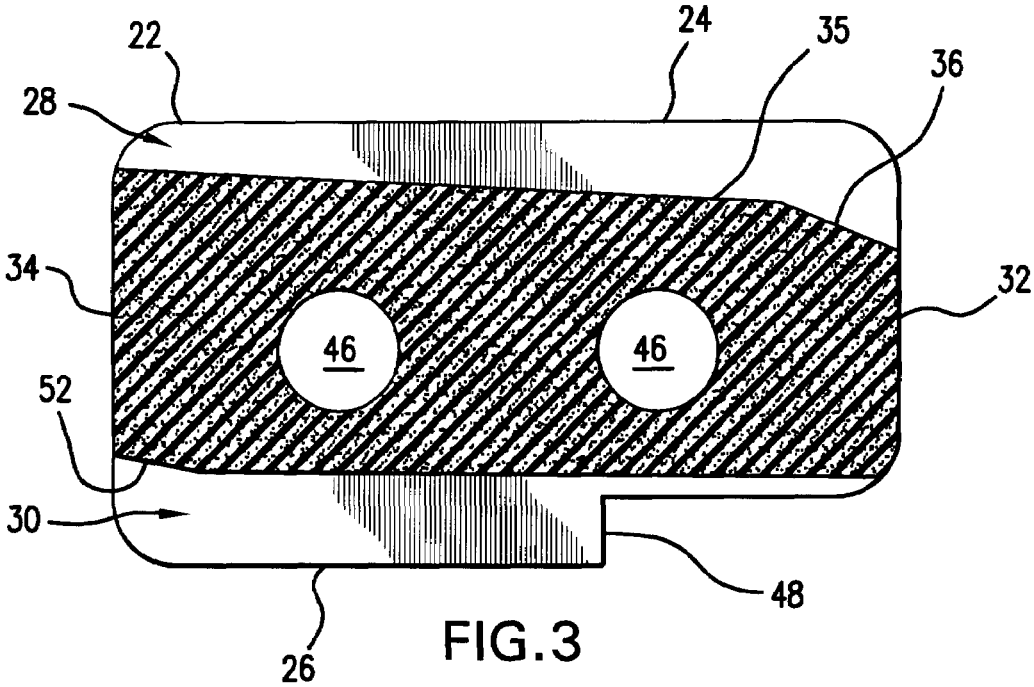
FIG. 3 is a cross-sectional view of the surgical arm pillow shown in FIG. 2 and taken along the line 3-3, FIG. 2.
Figure 4:
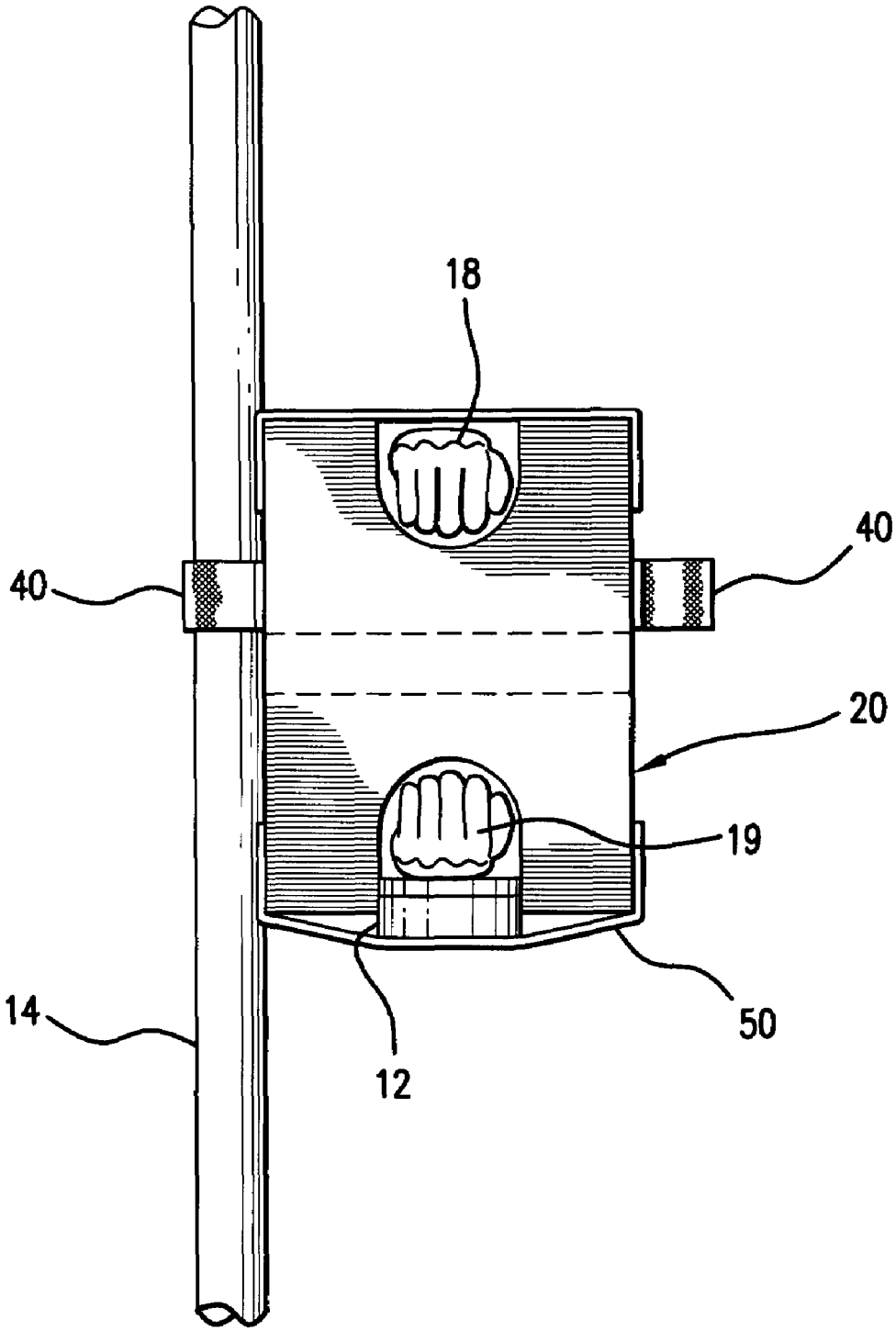
FIG. 4 is an end elevation view of the surgical arm pillow over the operating table arm board.

Referring to FIGS. 2 and 3, surgical arm pillow 20 primarily comprises a resilient foam body 22 that has a top edge 24 and a bottom edge 26. A top arm support channel 28 is formed in the top edge 24 of resilient foam body 22. Top arm support channel 28 is generally formed of sufficient depth to support a human arm 18 (FIG. 1) therein without the danger of arm 18 sliding off of top edge 24. In like manner, a bottom arm channel 30 is formed in bottom edge 26 of resilient foam body 22. Bottom arm channel 30 is wide enough to accept therein a human arm 19 (FIG. 1) and also wide enough to telescope over both arm 19 and at least a portion of arm board 12 attached to operating table 10 (FIG. 4).

In order to provide a most optimal positioning of the shoulders and arms 18, 19 of surgical patient 16, top arm support channel 28 is angled such that as channel 28 progresses from first end 32 of resilient foam body 22 toward second end 34 of resilient foam body 22, top arm support channel 28 diverges slightly away from bottom arm channel 30. The purpose of the divergence is to prevent the pinching of the brachial plexus nerve at the under-arm juncture of the patient's top arm 18 to the patient's shoulder and torso 17. Pinching of the brachial plexus nerve is further alleviated by a chamfered portion 36 of the bottom 35 of top arm support channel 28 at first end 32. Chamfered portion 36 substantially eliminates an edge at first end 32 of foam body 22 that could abut and apply undesired pressure on the patient's brachial plexus nerve. In like manner, a chamfered portion 52 can be formed in bottom arm channel 30 at second end 34 to accommodate the greater cross-sectional area of the patient's hand versus the patient's forearm.

A substantially rectangular notch 48 is cut out of resilient foam body 22 along bottom edge 26 at first end 32. Since the top of arm board 12 is substantially co-planar with the top of operating table 10, and since arm board 12 is desired to be at least partially received in bottom arm channel 30, notch 48 is required to be formed in bottom edge 26 to receive at least a portion of the edge 15 of operating table 10 for surgical arm pillow to be properly oriented. In instances where arm board 12 is too large to be received in bottom arm channel 30, there remains a sufficient portion of bottom edge 26 for surgical arm pillow 20 to be stably supported on one or both of operating table 10 and arm board 12.

Top edge 24 further defines one or more lateral slots 44 extending from the outer side 42 of resilient foam body 22 to an interior of top arm support channel 28. Lateral slots 44 accommodate the routing of intravenous lines 13 (FIG. 1) to the patient's arm 18. Further, while lateral slots 44 can be oriented at right angles with respect to a longitudinal direction (extending from first end 32 to second end 34) of top arm support channel 28, the most preferred orientation of slots 44 is at an acute angle therewith. The acute angle is preferred to prevent the sharp bending and possible kinking of intravenous lines 13 that would be more probable if oriented at right angles to top arm channel 28. Multiple slots 44 can be positioned along top edge 24 to accommodate various other physiological monitoring leads (not shown) and differing placements along the patient's arm 18.

A top adjustment strap 38 extends over the top of resilient foam body 22 and across top arm support channel 28. Top adjustment strap 38 ensures that patient's arm 18 is retained in top arm channel 28 and prevents it from inadvertently being dislodged therefrom. Similarly, a bottom adjustment strap 50 extends under bottom edge 26 of foam body 22 and across bottom arm channel 30. Bottom adjustment strap 50 is of sufficient length to extend both across bottom arm channel 30 and the underside of arm board 12 for the purpose of securing surgical arm pillow 20 in engagement with arm board 12. Adjustment straps 38 and 50 can employ a hook and loop releasable fasteners to accommodate quick and easy securing of straps 38 and 50.

A support strap 40 can be affixed to one or both sides of surgical arm pillow 20. Support strap 40 is oriented to allow a vertical support stanchion 14 to be retained against surgical support pillow 20. Vertical support stanchion 14 can be a standard IV stand on which are supported one or more IV bags for delivering fluids and medications to patient 16 through intravenous lines 13. The securing of stanchion 14 to surgical arm pillow 20 prevents the undesired movement or tipping of the surgical arm pillow 20 on the arm board 12 and the inadvertent pulling of intravenous lines 13 on patient's arm 18. Vertical stanchion 14, when secured to surgical arm pillow 20, further serves to support surgical arm pillow 20 in its desired vertical orientation. Support strap 40 is provided with hook and loop releasable fasteners to permit easy attachment and removal thereof.

As illustrated in FIGS. 1, 2, and 3, one or more pass through openings 46 can be formed intermediate to top arm support channel 28 and bottom arm channel 30 to permit the routing through surgical arm pillow 20 of various lines and tubes 11 necessary to the surgery being conducted.

In use, and as illustrated in FIGS. 1 and 4, a patient 16 is placed on operating table 10 in a lateral position such that patient 16 is lying on his or her side with arms 18, 19 extending substantially laterally outward from operating table 10. The patient's bottom arm 19 is placed on arm board 12 of the operating table 10. Next the bottom arm channel 30 of surgical arm pillow 20 is telescoped over the patient's bottom arm 19 such that at least a portion of arm board 12 on which the patient's bottom arm 19 is resting is also received in bottom arm channel 30. The patient's top arm 18 is placed in top arm support channel 28 of surgical arm pillow 20 and intravenous lines and physiological monitoring leads 13 attached to the patient's arm 18 are routed through lateral slot 44 extending from a side 42 of surgical arm pillow 20 into top arm support channel 28. Top arm support channel 28 is positioned such that the patient's top arm 18 diverges upwardly away from the patient's bottom arm 19, and top adjustable strap 38 is affixed over the top of top arm support channel 28 to secure the patient's arm 18 in top arm support channel 28, thereby supporting the top shoulder and arm without pinching or placing pressure on the brachial plexus nerve.

Surgical arm pillow 20 is slid close to the patient's torso 17 such that notch 48 in bottom edge 26 engages side portion 15 of operating table 10. Bottom adjustable strap 50 is then affixed around the bottom of arm board 12 to secure surgical arm pillow 20 to arm board 12. Finally, side support strap 40 on the side 42 of surgical arm pillow 20 is fastened around a vertical stanchion 14 to provide vertical stability to the pillow. If necessary, depending on the type and requirements of the surgery to be performed on patient 16, other lines, leads, and tubes can be conveniently passed through one or more pass through openings 46 laterally extending through surgical pillow 20.

Figure 5:
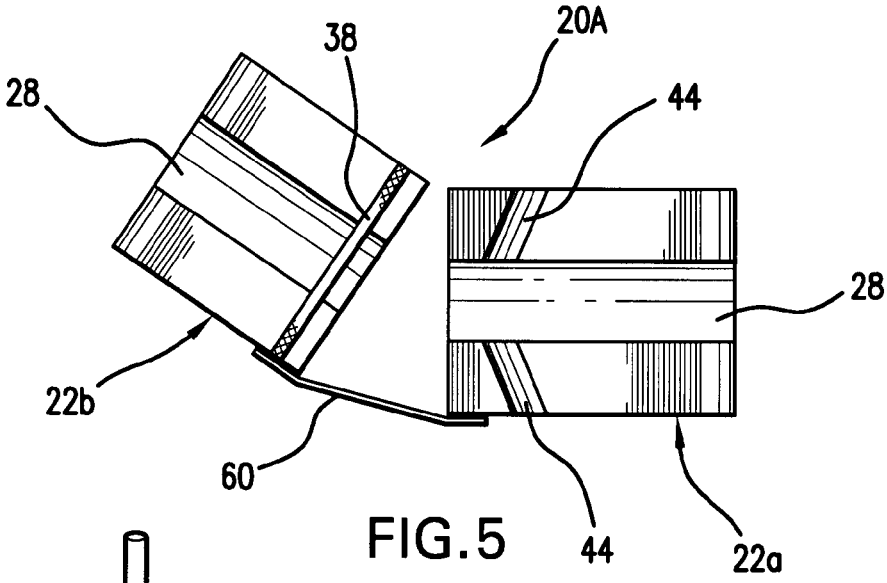
FIG. 5 is a top plan view showing an alternative embodiment of the surgical arm pillow, wherein the pillow splits vertically into two parts to allow for angled positioning of the patient's arms with a bend at the elbows.
Figure 6:
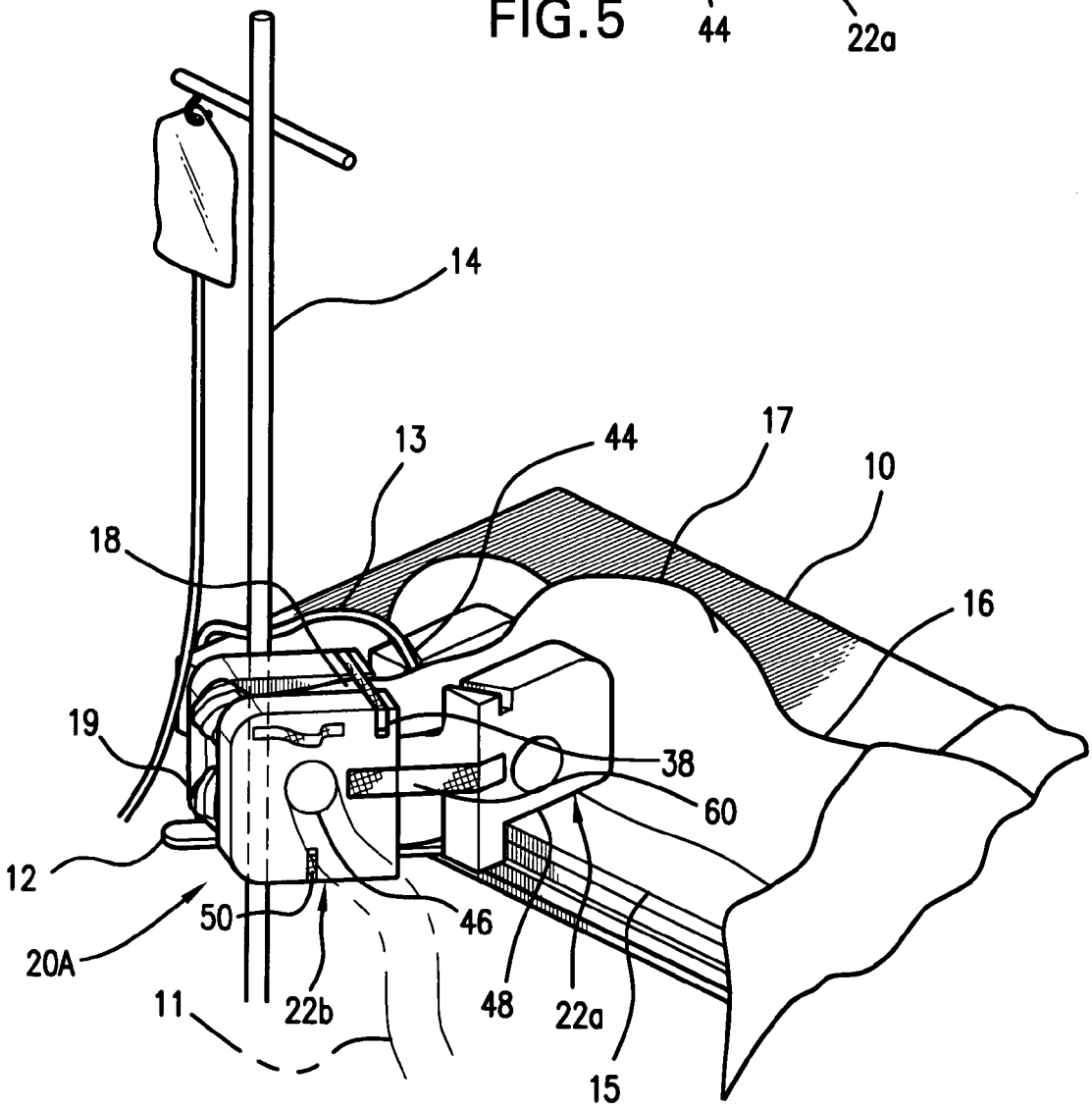
FIG. 6 is a perspective view of the surgical arm pillow of FIG. 5 showing a patient on an operating table in a lateral position and with the patient's arms supported by an arm board and the surgical arm pillow with a bend at the patient's elbows.

Referring to FIGS. 5 and 6, an alternative embodiment of the surgical pillow is shown and is generally indicated as 20A. The surgical pillow 20A splits vertically into two separate component pillow parts including an inboard pillow part 22*a* and an outboard pillow part 22*b*. Splitting the pillow 20A into the two parts 20*a*, 20*b* allows for angular positioning of the arm board 12 and patient's arms 18, 19 so the patient's arms bend at the elbow. An angular adjustment strap 60 releasably secures to the pillow parts 22*a*, 22*b* with hook and loop fasteners to hold the pillow parts 22*a*, 22*b* at the desired angled position.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

I claim:

1. A method for supporting the shoulders and arms of a surgical patient lying in a lateral position on an operating table having an arm board extending outwardly from a side of the operating table, wherein both of the patient's arms extend laterally outward from the side of the operating table, said supporting method comprising the steps of:

a. placing a bottom arm of the patient on the arm board of the operating table;

b. telescoping a bottom arm channel of a surgical arm pillow over the patient's bottom arm such that at least a portion of the arm board on which the patient's bottom arm has been placed is also received in the bottom arm channel;

c. placing the top arm of the patient in a top arm support channel of the surgical arm pillow;

d. routing intravenous lines and physiological monitoring leads attached to the patient's arms through a slot extending from a side of the pillow into the top arm support channel; and e. affixing the surgical arm pillow to of the arm board to secure the pillow to the arm board.

2. A patient positioning assembly for use with an operating table for supporting a patient in a lateral position on the operating table, said assembly comprising:

an arm board removably attachable to a side of the operating table for supporting at least one of the patient's laterally positioned shoulders and arms;

a resilient foam body having a top edge and a bottom edge, said top edge defining therein a top arm support channel for receiving and supporting the top shoulder and top arm of the laterally positioned patient, and said bottom edge defining therein a bottom arm channel receiving the bottom arm of the laterally positioned patient and at least a portion of the arm board therein, said top arm support channel and said bottom arm channel being vertically spaced one from the other by a distance approximately equal to the width of the shoulders of the human torso at a first end of said resilient foam body, said first end for positioning most proximate to the patient, and further wherein said top arm channel diverges from said bottom arm channel toward a second opposite end of said resilient foam body.

3. The patient positioning assembly according to claim 2 wherein a bottom portion of said top arm support channel is chamfered downwardly toward said first end of said resilient foam body to accommodate the armpit area of the top arm of a patient laterally positioned on the operating table.

4. The patient positioning assembly according to claim 3 wherein a depth of said bottom arm channel is greater than a cross-sectional dimension of a human arm.

5. The patient positioning assembly according to claim 3 further including a top adjustable strap extending across said top arm support channel for securing a patient's top arm in said top arm support channel.

6. The patient positioning assembly according to claim 3 further including on at least one side thereof a side support strap, said side support strap selectively repositionable for securing said at least one side of said surgical arm pillow to a vertical stanchion.

7. The patient positioning assembly according to claim 3 wherein said resilient foam body further defines at least one lateral slot in an upper edge thereof, said lateral slot extending from an exterior side of said resilient foam body to an interior of said top arm channel for receiving therein intravenous lines attached to a patient's arm received in said top arm support channel.

8. The patient positioning assembly according to claim 7 wherein said at least one lateral slot is angled other than at a right angle with respect to said top arm support channel.

9. The patient positioning assembly according to claim 3 wherein said resilient foam body further defines at least one lateral pass through opening extending from a front side to a back side of said resilient foam body and intermediate to said top arm support channel and said bottom arm channel for the purpose of routing lines and tubes therethrough.

10. The patient positioning assembly according to claim 3 wherein said resilient foam body further defines a notch in said bottom edge at said first end thereof, said notch for receiving therein at least a portion of the side of the operating table.

11. The patient positioning assembly according to claim 10 further including a bottom adjustable strap extending across said bottom support channel for securing said surgical pillow to the arm board.

12. A patient positioning assembly for use with an operating table for supporting a patient in a lateral position on the operating table, said assembly comprising:

an arm board removably attachable to a side of the operating table for supporting at least one of the patient's laterally positioned shoulders and arms;

a resilient foam body having a top edge and a bottom edge, said top edge defining therein a top arm support channel for receiving and supporting the top shoulder and top arm of the laterally positioned patient and said bottom edge defining therein a bottom arm channel receiving the bottom arm of the laterally positioned patient and at least a portion of the arm board therein, said top arm support channel and said bottom arm channel being vertically spaced one from the other a distance approximately equal to the width of the shoulders of a human torso, said resilient foam body further defining a notch in said bottom edge at a first end of said resilient foam body, said first end of said resilient foam body for positioning most proximate to the patient and said notch for receiving therein at least a portion of the side of the operating table.

13. The patient positioning assembly according to claim 12 further including a bottom adjustable strap extending across said bottom support channel for securing said surgical pillow to the arm board.

14. The patient positioning assembly according to claim 13 wherein a depth of said bottom arm channel is greater than a cross-sectional dimension of a human arm.

15. The patient positioning assembly according to claim 12 wherein a bottom portion of said top arm support channel is chamfered downwardly toward said first end of said resilient foam body to accommodate the armpit area of the top arm of a patient laterally positioned on the operating table.

16. The patient positioning assembly according to claim 12 further including a top adjustable strap extending across said top arm support channel for securing a patient's top arm in said top arm support channel.

17. The patient positioning assembly according to claim 12 wherein said resilient foam body further defines at least one lateral slot in an upper edge thereof, said lateral slot extending from an exterior side of said resilient foam body to an interior of said top arm channel for receiving therein intravenous lines attached to a patient's arm received in said top arm support channel.

18. The patient positioning assembly according to claim 12 wherein said resilient foam body further defines at least one lateral pass through opening extending from a front side to a back side of said resilient foam body and intermediate to said top arm support channel and said bottom arm channel for the purpose of receiving lines and tubes therethrough.

19. The patient positioning assembly according to claim 12 wherein said resilient foam body is split vertically into two pillow parts, and said two pillow parts being angularly adjustable relative to one another to provide for support of the top shoulder and arm of the patient with the patient's top and bottom arms positioned with a bend at the elbows.

* * * * *